United States Patent [19]

Kato et al.

[11] Patent Number: 4,821,466

[45] Date of Patent: Apr. 18, 1989

[54] METHOD FOR GRINDING USING A MAGNETIC FLUID AND AN APPARATUS THEREOF

[75] Inventors: Koji Kato, 3-16-8 Yagiyamaminami, Sendai City, Miyagi Prefecture; Noritsugu Umehara, Sendai; Shigeru Adachi, Izumi; Shin Sato, Natori, all of Japan

[73] Assignees: Koji Kato, Sendai; JGC Corporation, Tokyo, both of Japan

[21] Appl. No.: 152,937

[22] Filed: Feb. 5, 1988

[30] Foreign Application Priority Data

Feb. 9, 1987 [JP] Japan ..... 62-26443
Nov. 16, 1987 [JP] Japan ..... 62-287439

[51] Int. Cl.[4] ..... B24B 1/00; B24C 1/00
[52] U.S. Cl. ..... 51/317; 51/7
[58] Field of Search ..... 51/317, 6, 7, 17

[56] References Cited

U.S. PATENT DOCUMENTS 2,883,809 4/1959 Simjian ..... 51/317
4,306,386 12/1981 Sakulevich et al. ..... 51/7

*Primary Examiner*—Frederick R. Schmidt
*Assistant Examiner*—Maurina Rachuba
*Attorney, Agent, or Firm*—Cushman, Darby & Cushman

[57] ABSTRACT

It is an object of present invention to provide an efficient method for grinding of the surface of a work and an apparatus thereof, using a magnetic fluid containing abrasive grains.

The method of the present invention for grinding a work immersed in a magnetic fluid containing abrasive grains filled in a container, said magnetic fluid being given a magnetic field from the outside of the container with magnet comprises: immersing a floating pad in said magnetic fluid at a position adjacent to the work, said floating pad being given a buoyant force by said magnetic field whereby the abrasive grains existing between the floating pad and the work are pushed onto the work and giving a mutual motion between the work and the magnetic fluid containing abrasive grains.

In conventional method for grindings using a magnetic fluid containing abrasive grains and without the floating pad, the grinding load has been mainly dependent upon the buoyant force of abrasive grains, but the grinding rate thereby was too small owing to rather little buoyant force of abrasive grains.

According to the present invention using the floating pad, the grinding rate is significantly improved by strongly pushing abrasive grains onto the surface of the work, resulting from larger grinding load and the resistant power of the floating pad to the grinding direction.

9 Claims, 9 Drawing Sheets

METHOD FOR GRINDING USING A MAGNETIC FLUID AND AN APPARATUS THEREOF

FIELD OF THE INVENTION

The present invention relates to a method for grinding of the surface of a work, using a magnetic fluid containing abrasive grains in the presence of a magnetic field, especially relates to an efficient method for grinding and an apparatus thereof, by controlling the movement of abrasive grains, with a combination of the magnetic fluid, a floating pad and the magnetic field.

DESCRIPTION OF THE PRIOR ART

Various kinds of methods concernig the method for grinding of the surface of works by using magnetic fluid containing abrasive grains have been disclosed in Japanese patent public disclosures: Tokkaisho No. 51-10499, Tokkaisho No. 57-163057, Tokkaisho No. 57-158280, Tokkaisho No. 58-77447, Tokkaisho No. 59-102569, Tokkaisho No. 60-67057, Tokkaisho No. 60-118466, Tokkaisho No. 60-167761, Tokkaisho No. 60-186368, Tokkaisho No. 60-191759 and Tokkaisho No. 60-242963.

The basic principle of the conventional method for grinding of the surface of works using magnetic fluid containing abrasive grains will be explained in FIG. 8;

The surface of a work(3) to be ground is immersed in a magnetic fluid(2) containing abrasive grains filled in a container(1) under which magnets(4) are placed to supply a magnetic field to the magnetic fluid from the bottom part thereof.

Thus, abrasive grains are given a buoyant force by the magnetic field and moved up by the buoyant force to form a high density layer of abrasive grains in the upper part of the magnetic fluid, which comes to contact with the surface of the work. By a mutual motion between the work and the magnetic fluid containing abrasive grains, such as a revolution of the work around an axis as shown in FIG. 8, the surface of the work is ground.

There is an alternative method to make the mutual motion between the work and the magnetic fluid containing abrasive grains, which is achieved by revolution of the magnetic fluid containing abrasive grains by actuating the exterior magnetic field.

However, those conventional methods have never been used yet for the commercial purposes, owing to a very small grinding rate (ground amount per unit time), although the principle of them is applicable the purpose of grinding.

SUMMARY OF THE INVENTION

The object of the present invention is to provide an improved method for grinding and an apparatus thereof, to grind the surface of the work efficiently, by using a magnetic fluid containing abrasive grains and a floating pad.

DETAILED DESCRIPTION OF THE PREFERRED EMBODIMENTS

The method of the present invention for grinding a work immersed in a magnetic fluid containing abrasive grains filled in a container, said magnetic fluid being given a magnetic field from the outside of the container with magnet comprises: immersing a floating pad in said magnetic fluid at a position adjacent to the work, said floating pad being given a buoyant force by said magnetic field whereby the abrasive grains existing between the floating pad and the work are pushed onto the work and a mutual motion is given between the work and the magnetic fluid containing abrasive grains.

Figure 1A:
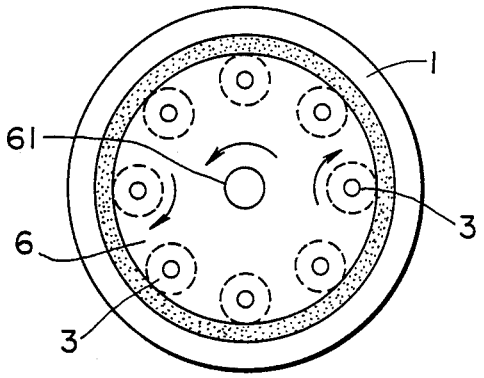
FIG. 1A and 1B, FIG. 2A and 2B, FIG. 3A and 3B, FIG. 4 and FIG. 5 are respectively showing the figures to explain the practical embodiments of the present invention.
Figure 1B:
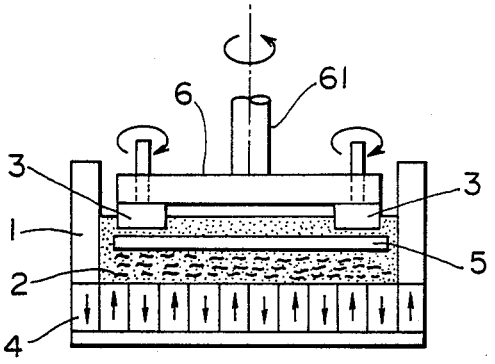

Applications of the pesent invention will be explained by using typical examples, in more detail;

FIG. 1A and FIG. 1B, show a practical example of grinding several numbers of works at a same time, in which FIG. 1A is a top view and FIG. 1B is a sectional side view thereof.

As shown in FIG. 1A and FIG. 1B, works(3) are placed to be able to revolve freely on the undersurface of a round plate(6) acting as a driving means, and are immersed in a magnetic fluid (2) containing abrasive grains in a container(1), and a floating pad(5) is immersed in the said magnetic fluid, just under the works(3).

By placing the magnetic fluid in a magnetic field generated by magnets(4) placed on a side parallel to the floating pad and opposite to the work, that is, under the said magnetic fluid in this case, abrasive grains are given a buoyant force caused by the magnetic field, and come up to the upper part in the magnetic fluid to form a high density layer of them.

At the same time, said floating pad(5) is given a buoyant force too and rises up to push abrasive grains existing in the upper portion thereof to the surface of the works(3).

Then, the round plate(6) is revolved around the perpendicular axis(61) and the undersurface of the work contacting with abrasive grains will be ground. In such a case, when said floating pad(5) is used, grinding rate will be significantly improved, compared with the case without it.

The degree of grinding power generated depends upon the buoyant froce and the stiffness of the floating pad as a resistant power to the grinding direction. The stiffness of the floating pad to the grinding direction is determined based on those factors as material, mass, shape and flow resistance thereof.

The material of the floating pad may be selected from among metal, plastic, ceramic, rubber and various kinds of materials, responding to the demands or degrees of grinding.

The buoyant force given to the floating pad depends upon the intension of the exterior magnetic field applied from underneath, the size of floating pad, and the clearance thereto, so on.

A desirable working load may be controlled arbitrarily by adjusting the above items.

It is not an absolute requirement that the density of floating pad is less than that of the magnetic fluid containing abrasive grains, and it will serve for the purpose, so long as the buoyant force thereof is generated by the magnetic field applied from the underneath.

The shape of the floating pad is desirable to be made to have same clearance at any part from the surface of the work, in compliance with the shape of the surface thereof, such as flat, curved or irregular one.

Figure 6A:
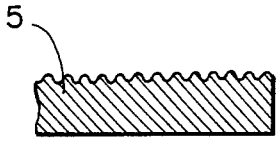
FIG. 6A, 6B and 6C are figures to illustrate the floating pad to be used in the present invention, in partly enlarged sectional view.
Figure 6C:
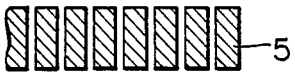
Figure 6B:
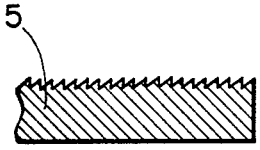

The surface of floating pad may be smooth, but as is shown in partly enlarged cross sectional view of FIG. 6A or FIG. 6B, it is preferable to have numerous grooves or cavities on the upper surface adjacent to the work to hold abrasive grains easily, or as is shown in FIG. 6C of same type of view, to have numerous penetrated holes in it to supply abrasive grains easily.

The mutual motion between the work and the abrasive grains in the magnetic fluid can be made by a revolution, a reciprocation, a vibration or the other kind of motion of the work, by a motion such as a reciprocation, a revolution or a vibration of the magnetic fluid containing abrasive grains by actuating the magnetic field, by a motion of the floating pad or by a combination of those motions.

The abrasive grains to be contained in the magnetic fluid may be selected and used appropriately from those grinding grains publicly known, for example, such as Al203(colundum), SiC(carborundum), diamond etc. Magnetized abrasive grains can also be used.

The magnet(4) for the generation of the magnetic field may be a single magnet or a group of magnets set side by side and arranged to have the same poles on a side.

However, it is more preferable to be a group of magnets set side by side, so as that the adjoined poles of them have different polarity each other (as shown by arrow marks in FIG. 1B). By such combination, magnetic buoyant force of the abrasive grains and the floating pad is increased and a magnetic buoyant force to the intersectional direction (in this case, the horizontal direction) at the same time to keep the abrasive grains so as to resist to the motional direction of the works.

Said magnet or a group of magnets may be either permanent magnet or electromagnet.

The magnet(s) may be placed under the container(1) as shown in FIG. 1B, but not be limited thereto, that is, the position of it (them) can be selected so as to generate a magnetic field gradient in such optional directions horizontal or oblique by arranging at an appropriate side position. In any case, the magnetic field must be applied from one side of the magnetic fluid in the container, to come out magnetic buoyant force in the abrasive grains and the floating pad.

Figure 2A:
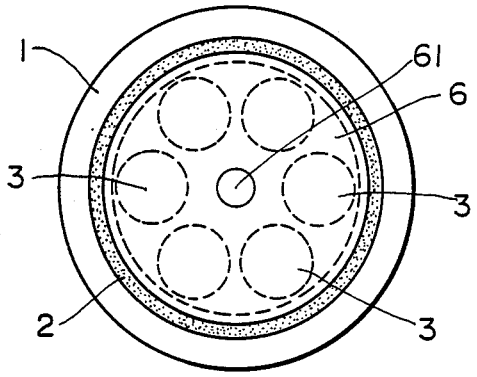
Figure 2B:
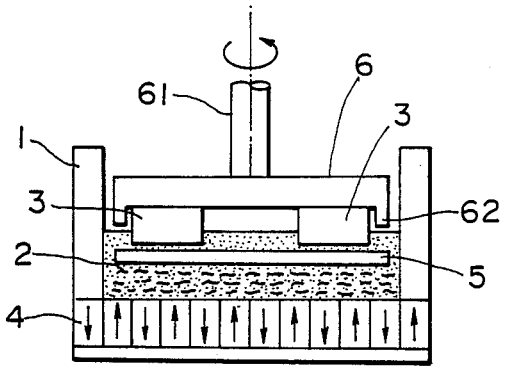

FIG. 2A and FIG. 2B are to explain another example to grind several numbers of works at a same time. FIG. 2A is a top view and FIG. 2B is a sectional side view, in which several works(3) are placed between a round plate(6) acting as a driving means and a floating pad(5) in a state of floating in a magnetic fluid(2) containing abrasive grains. When a magnetic field is applied from underneath, the floating pad(5) will be buoyantly moved up and push the abrasive grains onto the lower surface of the works(3). Then the round plate(6) is revolved around the perpendicular axis(61) and the works(3) are moved in the magnetic fluid containing abrasive grains under the restriction of the round plate(6), their outer side(62) and the floating pad(5), and the lower surface or the upper and the lower surfaces of the works(3) are ground.

Figure 3A:
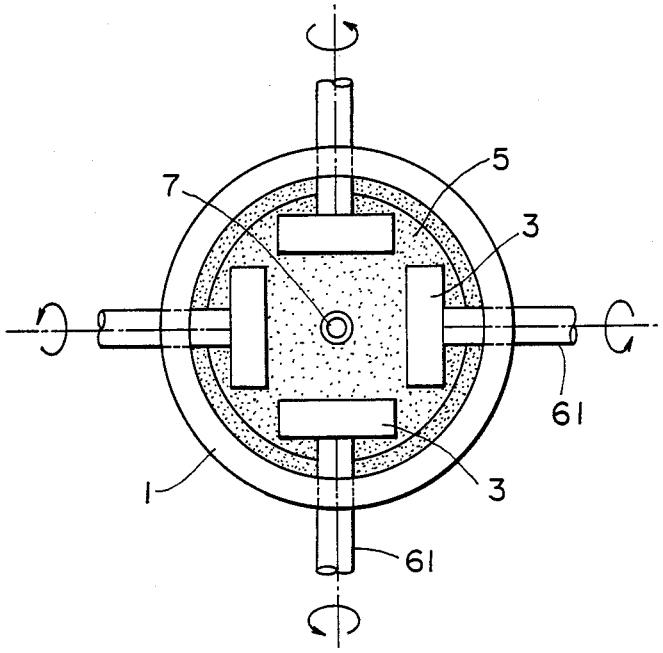
Figure 3B:
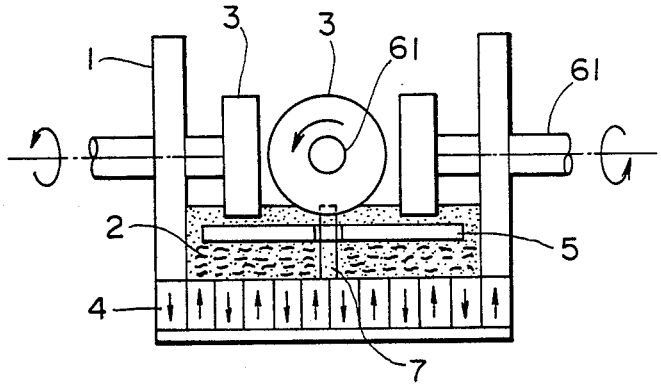

FIG. 3A and FIG. 3B are to explain how to grind the side of rings or round plates and FIG. 3A is a top view and FIG. 3B is a sectional side view.

Works of ring or round plate form(3) are installed on the horizontally revolving axis(61) and are revolved. Then the floating pad(5) immersed in the magnetic fluid containing abrasive grains is moved up and pushes abrasive grains existing on the upper surface thereof to the side of the revolving works(3) of ring or round plate form, and the side of the works are ground efficiently. In this case, it is desirable to set a supporting axis(7) at the center of the floating pad(5).

Figure 4:
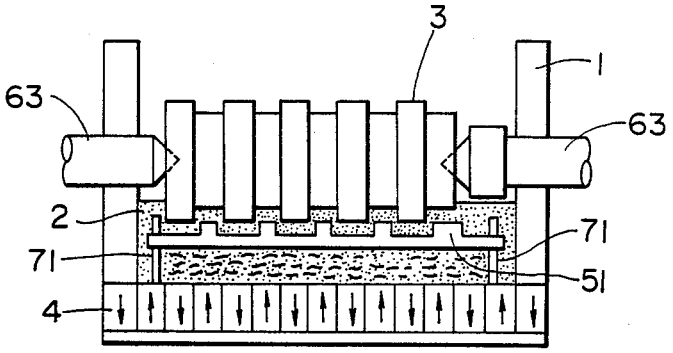

FIG. 4 is to explain the case of grinding a cylinder-shaped work with deep ditches around it, which is supported horizontally with driving means(63) and is revolved around. A floating pad(51) with the irregular surface corresponding to the said ditches of the work(3) pushes the abrasive grains existing in the upper layer onto the undersurface of the works(3) and the sides of the work(3) with ditches is effectively ground.

In this case, guide-pins(71) are keeping the floating pad from irregular rolling.

Figure 5:
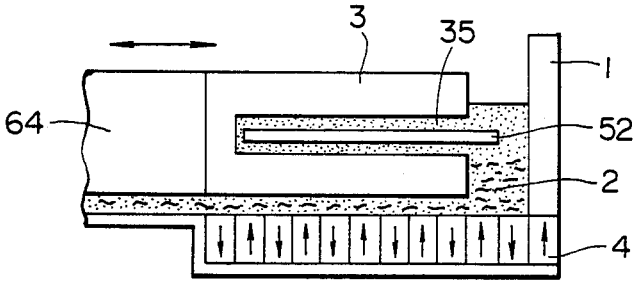

FIG. 5 is to explain the case of grinding the inner surface of a narrow hole of a work(3), where the narrow hole(35) of the work fixed with a holder(64) to keep a horizontal state is inserted with a needle-like floating pad(52) that is moved with a horizontal come and back reciprocating motion to grind the inside of the narrow hole(35) of the work.

When the section of the narrow hole(35) is round and the external form of the work is a round or a regular polygonal prism shape, it is considered that the work can be revolved around.

Further, it is possible to grind the inner surface of a ring or a pipe by applying a floating pad with a corresponding shape to the inner surface of the work, with the buoyant force of the floating pad caused by the magnetic field.

The method for grinding of the present invention using the floating pad is not limited to any of the embodiments described above, but rather be construed broadly applicable to a various kind of method for grindings using magnetic fluid containing abrasive grains.

EXAMPLE 1

Figure 7:
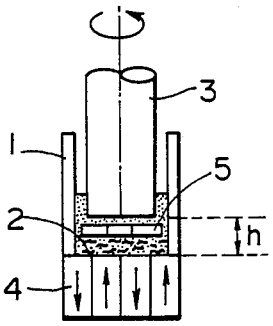
FIG. 7 shows the apparatus used in Example 1.
Figure 8:
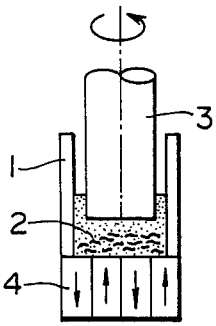
FIG. 8 (PRIOR ART)
FIG. 8 is to illustrate the apparatus in the prior art.

Using an apparatus having the structure shown in FIG. 8, a grinding test was done according to the conditions shown in Table 1 where a floating pad(5) was immersed into the magnetic fluid(2) containing abrasive grains at a position under the work(3) as shown in FIG. 7. Test results are shown in Table 2.

TABLE 1

| | |
|---|---|
| magnetic fluid | ferricolloid W-35 (water base) |

TABLE 1-continued

| | |
|---|---|
| | density; $1.4 \times 10^3$ kg/m$^3$ (25° C.) |
| | viscosity; 22.5 centigrade poise (25° C.) |
| abrasive grain | GC grain (SiC) #400 |
| | average particle size; 40 micrometer |
| | concentration; 30 volume % |
| work | acrylic resin cylinder (12 mm diameter |
| grinding time | 1 minute |
| revolving speed | 2650 rpm |
| floating pad | acrylic resin, doughnut type round plate (thickness; 2 mm) |
| clearance between work surface and magnet | 2.74 mm |

TABLE 2

| | Floating pad | Grinding rate (micrometer/min.) |
|---|---|---|
| Example 1 | used | 4.80 |
| Comparative Test 1 | not used. | 0.08 |

Grinding rate was calculated from the sectional curve of the edge part of the lower surface of the work.

COMPARATIVE TEST 1

Using the same apparatus having the structure shown in FIG. 8, and the same operation conditions as Example 1 except without a floating pad, a grinding test was carried out and its result was shown in Table 2.

Grinding rate was calculated from the sectional curve of edge part of the lower surface of the work as in Example 1.

With a floating pad (Example 1), the grinding rate was 60 times higher than that of the case without it (Comparative Test 1).

EXAMPLE 2

Figure 9:
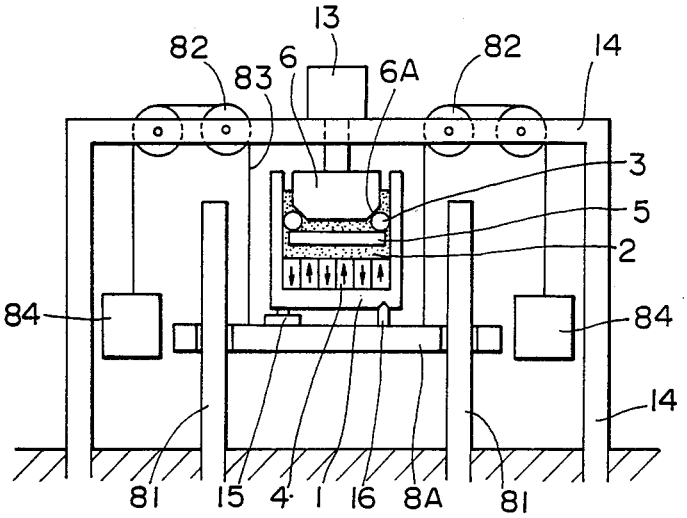
FIG. 9, 10 and 11 are respectively showing the embodiments of the apparatus of the present invention, in side view.
Figure 12:
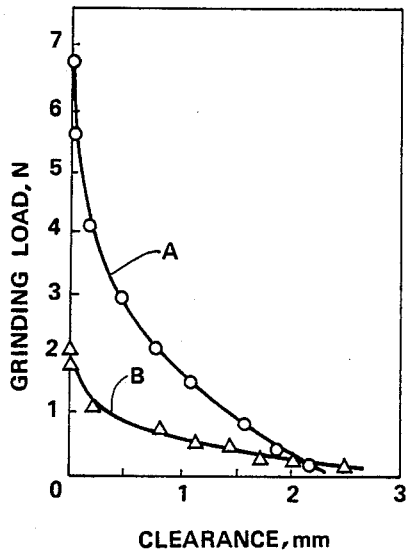
FIG. 12 shows the relation between the grinding load and the clearance of the upper surface of magnet from the work or the floating pad.
Figure 13:
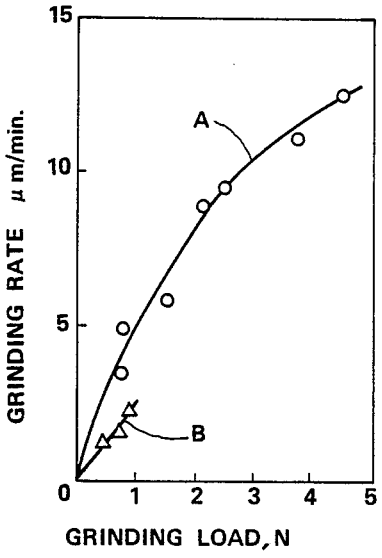
FIG. 13 shows the relation between the grinding load and the grinding rate, in which A-line is the case with the floating pad and B-line is without it.
Figure 14:
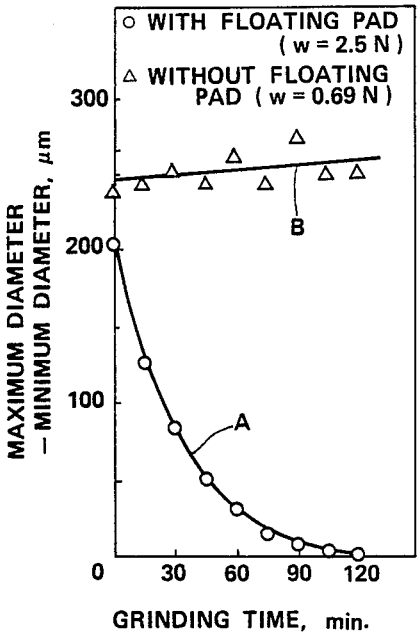
FIG. 14 shows the relation between the ball diameter variation and the grinding time, in which A-line is the case with the floating pad and B-line is without it.

Using an apparatus shown in FIG. 9, spherical works of $Si_3N_4$ with a diameter of about 9 mm were ground by the conditions shown in Table 3 and the results are shown in FIG. 12, FIG. 13 and FIG. 14.

COMPARATIVE TEST 2

Using the same apparatus and the same operation conditions as Example 2 except without a floating pad, spherical works of $Si_3N_4$ with a diameter of about 9 mm were ground and the results are shown in FIG. 12, FIG. 13 and FIG. 14.

TABLE 3

| | |
|---|---|
| magnetic fluid | ferricolloid W-40 (water base) |
| | density; $1.4 \times 10^3$ kg/m$^3$ (25° C.) |
| | viscosity; 22.5 centigrade poise (25° C.) |
| abrasive grain | GC grain (SiC) #400 |
| | average particle size; 40 micrometer. |
| | concentration; 10 volume % |
| work | $Si_3N_4$ sphere. |
| grinding time | 5–20 minute |
| revolving speed | 9000 rpm |
| floating pad | acrylic resin, round plate. (thickness; 2 mm) |

FIG. 12 shows the relation between the grinding load (ordinate) and the clearance (abscissa) between the upper side of the magnet(4) and the spherical works(3) or the floating pad(5), in which A-line shows the data used the floating pad and B-line shows the data without it.

FIG. 13 shows the relation between the grinding load (abscissa) and the grinding rate (ordinate), in which A-line shows the data using the floating pad and B-line shows the data without it.

FIG. 14 shows the relation between the ball diameter variation (ordinate), that is the difference between the maximum diameter and the minimum diameter in a ball, and the grinding time (abscissa), in which A-line is the case with the floating pad and B-line is without it.

In the method for grinding using a magnetic fluid containing abrasive grains, it is apparent from FIG. 12 and FIG. 13 that the smaller clearance between the work and the magnet, which gives the more intensive magnetic buoyant force, the larger grinding load is given, and the larger grinding load gives the larger grinding rate, and the use of the floating pad brings about the higher grinding rate caused by the larger grinding load.

As explained above, to increase the grinding rate in the method using magnetic fluid containing abrasive grains, it is desirable to shorten the clearance between the upper part of the magnet and the work or the floating pad as small as possible, by adjusting the position of the driving means. But the upper part of the magnet must not contact directly with the work or the floating pad.

Accordingly, it is not so easy to set this initial operation condition optimum and constant at repeated operations.

Furthermore, when the work or the driving means wears away accompanying with the advance of grinding, the clearance between the work and the magnet becomes larger and as the results grinding load becomes gradually to give less grinding rate. So, it is necessary to adjust frequently the position of the driving means to prevent from the above matters, but it is rather troublesome.

Figure 10:
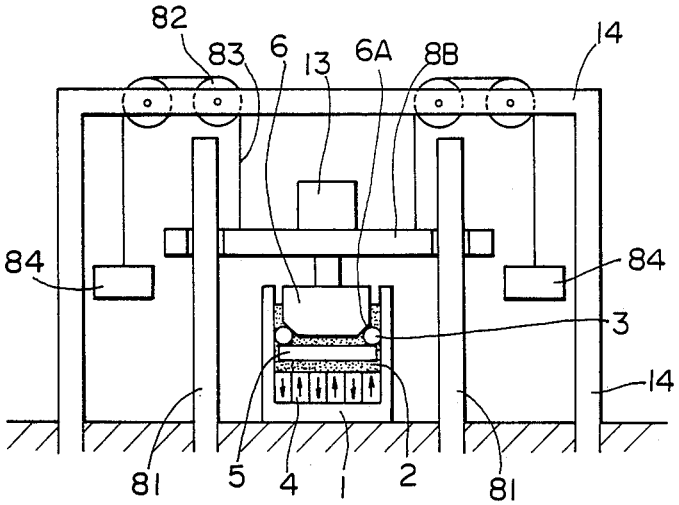
Figure 11:
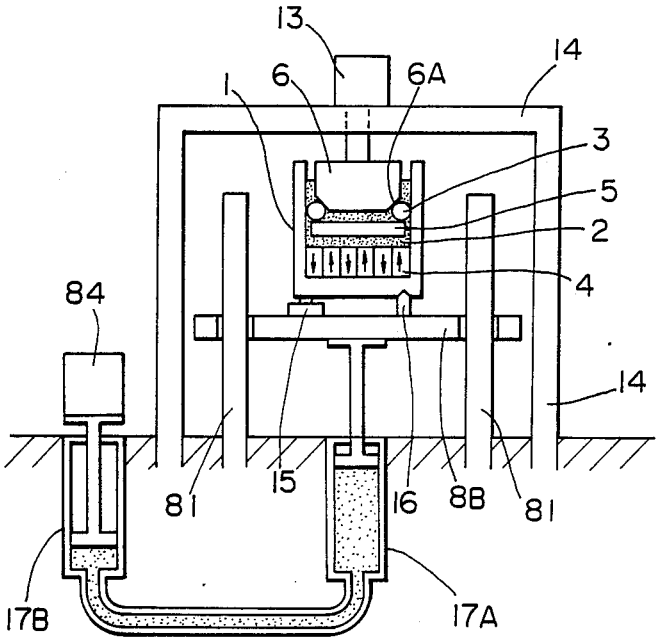

The apparatuses shown in FIG. 9, 10 and 11 as examples, may solve out such a inconvenience. They may be easier to keep the optimum initial conditions and keep the grinding load constant automatically during the grinding process.

The apparatus of the present invention for grinding a work with a magnetic fluid containing abrasive grains filled in a container by immersing the work in said magnetic fluid comprises;

(1) a magnet(s) being placed under the bottom of the container to give a magnetic field to said fluid, (2) a means for driving the work in said magnetic fluid in a fashion of holding the work to the bottom surface of it, (3) a floating pad being immersed in said magnetic fluid, thereby the abrasive grains existing between the floating pad and the work being pushed onto the work, and (4) said container or the means for driving the work being held vertically slidable and equipped with a mechanism to give a constant load between the floating pad and the work.

FIG. 9 shows an illustrative structure of an apparatus in which the container is slidable vertically.

Under a driving means(6) having a driving surface(6A) at the lower part, a container(1) is set, which is filled with a magnetic fluid(2) containing abrasive grains. A floating pad(5) is immersed in the magnetic fluid(2) so as to be able to hold work(3) between the lower part of the driving means(6). The container is equipped with magnets(4) at the bottom and mounted on a base(8A) which is slidable vertically along the guide-posts(81) penetrated therethrough. Accordingly the container(1) can slide vertically together with the base(8A).

The container(1) is mounted on the base(8A) which is suspended by ropes(83). An weight(84) is equipped at the each opposite end of the ropes through rollers(82).

If the total weight of the weights(84) is same as the total weight(B) of the magnets(4), the magnetic fluid(2), the floating pad(5), the container(1) and the base(8A), it will be balanced. But, assuming that the total weight of weights(84) is (B+W), the base(8A) slides upward and thus the container(1) and the driving means(6) are pushed each other by a constant load(W), which is equal to the total buoyant force of the floating pad(5) and the lord between the floating pad(5) and the work(3), which corresponds to the grinding load on the work(3).

By the way, mark(13) means a motor of the driving means (6), mark(14) means a frame to support the driving means(6), mark(15) means a load-cell to check the value of B+W and mark(16) means the fulcrum of the container(1).

FIG. 10 shows an illustrative structure of an apparatus at which the driving means is slidable vertically.

The driving means(6) having a driving surface(6A) at the lower part is mounted on a base(8B), which is slidable vertically along the guide-posts(81) penetrated through the base(8B). Accordingly the driving means(6) is slidable vertically together with the base(8B).

The base (8B) mounting the driving means(6) is suspended by ropes(83) and pulled by the weights(84) attached at the end of the ropes through rollers(82) installed there.

The container(1) is fixed to the lower part of the driving means(6).

If the total weight of the weights(84) is the same as the total weight(C) of the driving means(6), the motor(13) and the base(8) etc., it will be balanced. But if the total weight of the weights(84) is lessC-W), the base(8B) slides downward and thus the container(1) and the driving means(6) are pushed each other by a constant load(W), which may be equal to the total buoyant force of the floating pad(5) and the load between the floating pad(5) and the work(3), which corresponds to the grinding load on the work(3).

FIG. 11 shown another illustrative structure of an apparatus in which the container is slidable vertically.

The container(1) including the base(8) are mounted on a liquid type jack(17A), with which another liquid type jack(17B) is connected, whereon the weight(84) is loaded.

If the total weight(B) of the magnets(2), the magnetic fluid(3), the floating pad(5), the container(1) and the base(8A) etc. is the same as the weight of weight(84), as explained in FIG. 9, both are well-balanced each other.

On the other hand, if the weight of the weight(84) is more(B+W), the container(1) together with the base(8A) will slide up and both the container(1) and the driving means(6) are pushed each other by a constant load(W).

While examples of the mechanism to give a constant load between the floating pad and the work are shown in FIG. 9 to FIG. 11, it will be understood that various kinds of mechanisms may be applied therein.

For example, the weight may be worked by applying the principle of a lever, instead of the mechanism using the roller and the rope as shown in FIG. 9 and FIG. 10.

Or, without installing a pair of liquid jack(17B) as shown in FIG. 11, the liquid jack(17A) may be supplied with pressured liquid by pump. Moreover, a mechanical jack may be useful instead of the liquid jack(17B). In these cases, vertical motion of jack is controlled to bear a certain load on the container(1) always by checking it will the load-cell(15).

FIG. 9,10 and 11 show the apparatus wherein the container has a cylindrical form and the driving means revolves around the axis (vertical axis in Figures), which is suitable to grind the spherical work.

The driving surface(6A) of the driving means(6) is to transmit the motion to the spherical work pushed from underneath and also acts as a lap-plate (overhead lap-plate) for grinding of the spherical work. The spherical work(3) immersed in the magnetic fluid(2) containing abrasive grains is affected by the magnetic field to float magnetically and to push on the driving surface(6A) of the driving means located above.

When the driving means(6) is made to move, the motion is transmitted to the spherical works(3) and they revolve in the magnetic fluid(2) containing abrasive grains. Their motion is controlled by the inside surface of the container(1) as a guide-wall, as well as the driving surface(6A) of the driving means(6).

The floating pad(5) is placed under the work (3), to push the spherical work(3) more on the driving surface(6A) of the driving means(6) and plays as a part of guide-wall to control the motion.

Even though the magnetic buoyant force and the density difference between the magnetic fluid and the work are not enough to float the work, the floating pad with more buoyant force may be used to push the work to the driving surface(6A).

It is not an absolute requirement that the density of the floating pad is lighter than that of the magnetic fluid and it is considered enough when the magnetic buoyant force thereof is brought about by the magnetic field working from underneath.

EXAMPLE 3

Using the apparatus shown in FIG. 9 it was tested that the relation between the grinding rate and the concentration of abrasive grains to the magnetic fluid following Example 2, where the grinding load was 2.5N(Newton) and the grinding time was 5 min.

Figure 15:
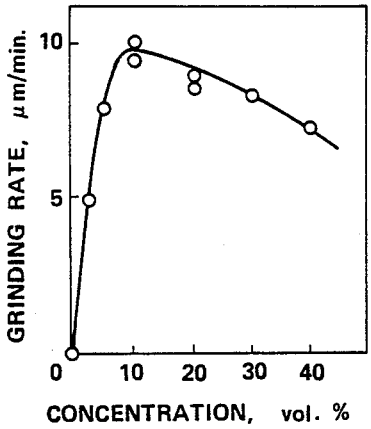
FIG. 15 shows the relation between the grinding rate and the addition rate of abrasive grains to magnetic fluid.

FIG. 15 illustrates the result, in which the abscissa is the concentration(volume %) of abrasive grains and the ordinate is the grinding rate(micrometer/min). It is understood that the optimum concentration of abrasive grains is in the range of 5–30%, more preferably in the range of 10+2% by volume.

EXAMPLE 4

Using the apparatus shown in FIG. 9, it was tested that the relation between the grinding rate and the particle size of abrasive grains following Example 2, where the grinding load was 2.5 N(Newton), the addition rate of abrasive grains was 10% and the grinding time was 5 min.

Figure 16:
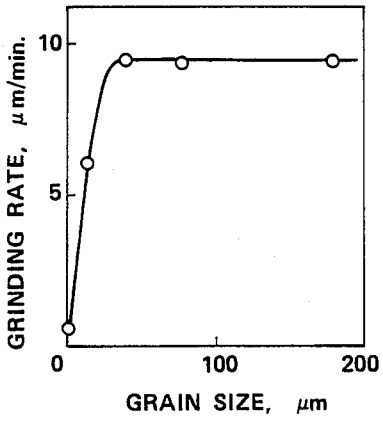
FIG. 16 shows the relation between the grinding rate and the particle size of abrasive grains.

FIG. 16 illustrates the result, in which the abscissa is the particle size(micrometer) of abrasive grains and the ordinate is the grinding rate(micrometer/min).

It is understood that the grinding rate is increased in proportion with the particle size of abrasive grains, but it will be almost in steady state where the particle size is more than 40 micrometer.

The method for grinding of the present invention has the following advantages;

(1) As the grinding is performed in the magnetic fluid containing abrasive grains, grinding load on the work is soft, without overload or impulse thereon and it is easily applicable to the brittle material like ceramic, ductile material like aluminium or other hardly processing material, with the least damage or deterioration during grinding.

(2) In the heat generated during grinding is removed efficiently, high speed grinding is possible together with above-written soft grinding load and the grinding efficiency is improved as the result.

(3) At the conventional method for grinding using a magnetic fluid containing abrasive grains without a floating pad, in which the grinding load is mainly based on the magnetic buoyant force of the abrasive grains, the grinding rate is very small because of the small buoyant force of the abraisve grains.

According to the present invention using a floating pad, abrasive grains are strongly pushed onto the surface of the work to grind by the magnetic buoyant force of the floating pad, the improved grinding load and the reaction force of the floating pad to the grinding direction, the grinding rate is significantly improved.

(4) By modifying the shape of the floating pad responding to the surface shape of the work, it is possible to grind even the surface of the work with irregular or complicated shape.

The grinding apparatus of the present invention has the following advantage; The apparatus of present invention makes easier to set the initial operating conditions at optimum and constant states and to keep grinding load constant automatically, by which grinding efficiency is improved.

We claim:

1. A method for grinding a work immersed in a magnetic fluid containing abrasive grains filled in a container, said magnetic fluid being given a magnetic field from the outside of the container with magnets, which comprises immersing a floating pad in said magnetic fluid at a position adjacent to the work, said floating pad being given a buoyant force by said magnetic field whereby the abrasive grains existing between the floating pad and the work are pushed onto the work and a mutual motion is given between the work and the magnetic fluid containing abrasive grains.

2. A method according to claim 1, wherein the mutual motion between the work and the magnetic fluid containing abrasive grains is given in the form of reciprocation, revolution or vibration of the work.

3. A method according to claim 1, wherein the mutual motion between the work and the magnetic fluid containing abrasive grains is given in the form of reciprocation, revolution or vibration of the magnetic fluid by actuating the magnetic field.

4. A method according to claim 1, wherein the floating pad is provided with numerous grooves or cavities on the surface thereof.

5. A method according to claim 1, wherein the floating pad is provided with numerous penetrated holes, the abrasive grains passing through.

6. A method according to claim 1, wherein a driving means is used to drive the work in order to give a mutual motion between the work and the magnetic fluid containing abrasive grains.

7. A method according to claim 6, wherein the work is placed between the driving means and the floating pad.

8. A method according to claim 1, wherein the magnet comprises a group of magnets placed side by side, in which adjoined poles of them have different polarity each other.

9. An apparatus for grinding a work with a magnetic fluid containing abrasive grains filled in a container by immersing the work in said magnetic fluid, which comprises;

(1) magnet means being placed outside the container and under the bottom floor to give a magnetic field to said magnetic fluid, (2) a means for driving the work in said magnetic fluid, (3) a floating pad placed in said magnetic fluid, so that the abrasive grains existing between the floating pad and the work are pushed onto the work, and (4) means to vertically position said container relative to said means for driving the work, said positioning means including means to maintain a constant load between the floating pad and the word.

* * * * *